US005549333A

United States Patent [19]

Uherek, Sr. et al.

[11] Patent Number: 5,549,333

[45] Date of Patent: Aug. 27, 1996

[54] BLAST JOINT

[76] Inventors: Robert J. Uherek, Sr., 2804 SE. Dune Dr., Unit 1309, Stuart, Fla. 34996; Paul J. Uherek, 6782 Salem Rd., Plymouth, Mich. 48170; Brain Uherek, 2804 SE. Dune Dr., Unit 1309, Stuart, Fla. 34996

[21] Appl. No.: 303,937

[22] Filed: Sep. 8, 1994

[51] Int. Cl.[6] ..... F16L 55/00; E21B 17/10

[52] U.S. Cl. ..... 285/45; 166/243; 166/902

[58] Field of Search ..... 166/902, 243; 285/45

[56] References Cited

U.S. PATENT DOCUMENTS

| | | | |
|---|---|---|---|
| 2,925,097 | 2/1960 | Duesterberg | 138/64 |
| 3,034,912 | 5/1962 | Flowers | 166/243 |
| 3,047,025 | 7/1962 | Davis | 166/243 |
| 3,365,000 | 1/1968 | Arnwine . | |
| 3,382,930 | 5/1968 | Ribb et al. | 166/242 |
| 4,028,796 | 6/1977 | Bergstrom | 29/416 |
| 4,141,386 | 2/1979 | Bergstrom | 138/147 |
| 4,211,440 | 7/1980 | Bergstrom | 285/45 |
| 4,349,050 | 9/1982 | Bergstrom et al. | 166/243 |
| 4,613,165 | 3/1986 | Kuhne | 166/243 |
| 4,635,968 | 1/1987 | Kunne | 166/243 |
| 4,685,518 | 8/1987 | Claycomb | 166/243 |
| 4,726,423 | 2/1988 | Claycomb | 166/380 |
| 4,889,185 | 12/1989 | Uherek, Sr. et al. | 166/243 |
| 4,911,479 | 3/1990 | Claycomb | 166/243 |
| 5,016,921 | 5/1991 | Claycomb | 166/243 |
| 5,275,441 | 1/1994 | Claycomb | 166/243 |
| 5,377,751 | 1/1995 | Unerek et al. | 166/241.6 |

OTHER PUBLICATIONS

Introducing Claycomb Carbide Blast Joint Modular Kits, 1986.

Rickert Precision Industries, Inc. Tungsten–Carbide Blast–Joint Kits, 1986–1987 First Printing.

Rickert Precision Industries, Inc. Modular Blast Joint Assembly and Running procedure with Centralizers, Mid 1991.

*Primary Examiner*—Eric K. Nicholson

*Attorney, Agent, or Firm*—Jenkens & Gilchrist, P.C.

[57] ABSTRACT

A blast joint for protecting production tubing passing through a producing zone including one or more tubing joints of sufficient length to extend through the producing zone, erosion resistant carbide rings mounted on the tubing joints in end-to-end array, ring retainers at each end of the erosion resistant rings to hold the rings on the tubing joints, and one or more elastomer spacer rings engaged with the erosion resistant rings for holding the erosion resistant rings in end-to-end array and being yieldable axially by outward displacement in response to movement of the erosion resistant rings along the tubing joint to permit the rings to move in response to lateral bending of the tubing joints and impact forces on the blast joint during assembly and installation to minimize damage to the erosion resistant rings. The carbide rings are larger than the tubing joints to permit lateral bending of the tubing joints in the rings without stressing the rings.

14 Claims, 5 Drawing Sheets

BLAST JOINT

BACKGROUND OF THE DISCLOSURE

The present invention is related to apparatus for protecting oil and gas production tubing passing through a producing zone subjected to the erosive effects of high velocity fluids and solid particles entrained in the fluids flowing into a bore hole around the tubing. More particularly, this invention relates to blast joints to provide maximum erosion protection for production tubing along perforated blast zones providing protection for any length of production tubing including single joints and tubing comprising multiple tubing joints.

It is common when drilling oil and gas wells to encounter two or more producing formations or zones. In such a situation, each producing formation is produced through a separate string of production tubing extending into the well bore. Typically, a string of production tubing extends to the lowermost producing formation. A packer is set about the production tubing string between the producing formations to isolate the upper producing formation from the lower producing formation. A second string of production tubing extends into the well bore to the upper producing formation. A packer is set above the upper producing formation to close off the annulus about the two strings of production tubing so that the upper production zone is isolated between the two packers. Thus, each string of production tubing is in fluid communication with the producing formation adjacent the lower open end of the production tubing. This is commonly referred to as a dual completion well.

Downhole well equipment is exposed to erosive elements in the well bore. This is particularly true in a dual completion well where one string of production tubing extends through an upper producing zone. Flow into the well bore in the upper producing zone, particularly in formations producing high pressure gas, is at high velocities. Abrasive materials, such as unconsolidated sand grains, are often entrained in the fluid stream and impinge on the production tubing. This action is extremely abrasive and erodes the pipe surface, thus requiring replacement of the production tubing. This is a very time consuming process which may be repeated often, particularly for wells having high sand content.

Blast joints adaptable to protecting a series of tubing joints or pipe are disclosed in U.S. Pat. No. 4,685,518, issued Aug. 11, 1987, U.S. Pat. No. 4,726,423, issued Feb. 23, 1988, and U.S. Pat. No. 4,889,185, issued Dec. 26, 1989. While the blast joint assemblies disclosed in such patents are suitable for the intended purposes, field experiences with such blast joints reveal the need for improvements which are met by the present invention. The patented blast joints include erosion resistant rings mounted on tubing sections connectable into production tubing at locations to position the erosion resistant rings along production zones to protect the tubing from erosive materials entering the well bore from the producing zones. The above noted prior art patented devices include coil springs mounted on the tubing joints arranged in spaced relation along the tubing between groups of the erosion resistant rings. The coil springs are compressed sufficiently to urge the erosion resistant rings together in end-to-end array along the tubing. Field experiences have demonstrated several disadvantages in the use of the coil springs to produce the necessary forces for holding the erosion resistant rings together during the handling and installation of the blast joints in a well. The protective rings employed to protect production tubing against high velocity particles are generally tungsten-carbide rings which are held together on the tubing by the coil springs with sufficient compressive force to maintain a continuous sheath of the rings along the tubing while allowing some movement of the rings during the handling of the blast joints required by the installation and operational procedures. During the lifting of assembled blast joints from horizontal positions to the vertical positions necessary to install the joints in a well, the bending stresses are maximum when the joints are in the horizontal position. Tubing joints and blast-ring assemblies are generally hoisted by one end from a horizontal position in the storage rack to a vertical position for installation. During the deflection caused by the horizontal loads on the joints, upper portions of the rings go into compression while lower portions go into tension. The use of the coil springs permits movement of the rings on the tubing to minimize the effects of the forces on the rings caused by the handling. It has been found, however, that the coil springs tend to permit excessive movements of the rings which may damage the rings. During the lowering of the prior art blast joints utilizing coil springs, the rings may rub along the bore hole walls compressing the coil spring and causing the rings to separate which may damage the rings and permit debris to enter the gaps between the rings. Additionally, debris may collect around the coil springs interfering with the ability of the springs to function properly. Further, during installation it may be necessary to jar the tubing string including the blast joint resulting in the rings separating and then the gap between the rings reclosing causing the rings to be chipped.

SUMMARY OF THE DISCLOSURE

The invention of the present disclosure is directed to an improved blast joint which may range from one tubing joint to several tubing joints of substantial length. The blast joint of the invention comprises a series of erosion resistant rings mounted about one or more tubular members connected end-to-end. Where several tubing joints are employed, pin and box ends of the tubular members are connected by a coupling which is shielded from erosive material by an adjustable erosion resistant sleeve positioned to enclose the coupling prior to positioning the blast joint in the well bore. The erosion resistant rings are installed on the tubing joints between end located retaining collars permitting some degree of movement of the erosion resistant rings relative to the supporting tubular members. The inside diameter of the erosion rings is larger than the outside diameter of the tubing joints providing clearance to permit limited flexing of the tubing without excessive forces on the rings. One or more elastomer impact spacer rings are mounted on the blast joint at selected locations along the length of the blast joint at one end of each erosion ring series, the impact rings being yieldable to permit movement of the rings along the tubular members to minimize damage to the rings. The elastomer impact rings maintain proper spacing of the erosion resistant carbide rings to hold them in non-compressive end-to-end contact so that debris does not collect between them while being sufficiently yieldable to minimize damage of the rings due to bending and impact forces during handling, installation, and functioning of the blast joint. Further, debris may not collect between the elastomer rings and the carbide rings.

BRIEF DESCRIPTION OF THE DRAWINGS

The objects and advantages and a preferred embodiment of the invention will be understood from the following detailed description taken in conjunction with the accompanying drawings wherein:

FIGS. 2A–2D taken together form a longitudinal view in elevation and section of one embodiment of the blast joint of the invention wherein FIG. 2A shows the upper retention collar, FIG. 2B shows the lower end of the top joint connected into an intermediate joint protected by a short coupling shield, FIG. 2C shows the intermediate joint connected with a bottom joint protected by a long coupling shield, and FIG. 2D shows the lower retention collar;

DESCRIPTION OF THE PREFERRED EMBODIMENT

Figure 1:
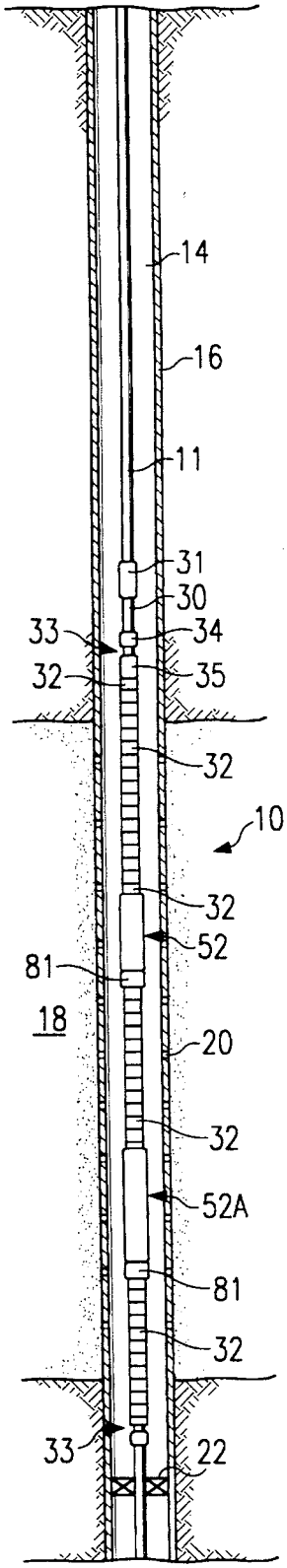
FIG. 1 is a side longitudinal view in elevation and section of a producing string in a well bore intersecting a production zone, the string including a blast joint of the present invention protecting the tubing along the producing formation.

Referring to FIG. 1, a blast joint 10 comprising several protected tubing joints forms a portion of a production tubing string 11 disposed in a well bore 14 lined with a well casing 16 intersecting a producing formation 18. The casing is perforated at 20 along the producing formation to permit formation fluids to flow into the well bore around the production string along the blast joint. A well packer 22 is installed around the production tubing within the casing to seal between the tubing and casing below the production formation to isolate the formation fluids flowing into the well bore from the formation 18 so that the fluids will flow in the casing up the well bore around the production string. Fluids from formations below the formation 18 are produced through the production string from below the packer 22. The fluids from the formation 18 may flow to the surface in the well bore 14 through the annulus between the production string and the casing. The blast joint of the invention functions to protect the production tubing 11 from erosion caused by high velocity well fluids and entrained particles flowing into the tubing through the perforations 20 around the production tubing along the blast joint. The blast joint 10, thus, functions as a protective sheath or shield of erosion resistant material enclosing the production tubing 11 to protect it from the erosive action of the high velocity fluid and entrained particles.

Figure 2A:
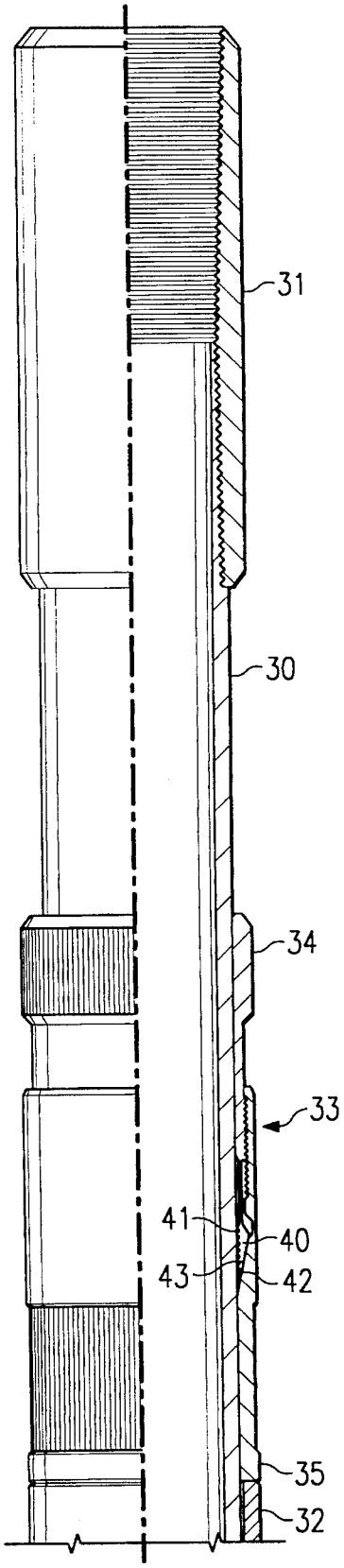

Referring to FIGS. 1 and 2A, a top joint 30 of the blast joint 10 is connected into the production tubing 11 by a coupling 31. A plurality of protective rings 32, preferably formed of tungsten-carbide, are assembled in end face-to-face contact on the top joint 30 restrained at the upper end on the joint by a ring retainer 33 comprising a slip ring 34 threaded along a lower end portion into a bowl ring 35. The slip ring has a plurality of dependant locking fingers 40 each provided with an internal serrated surface 41, and a tapered external surface 42 engageable with an internal tapered bowl surface 43 in the bowl ring 35. As the slip ring 34 is threaded into the bowl ring 35, the external tapered surfaces 42 on the locking fingers engage the tapered bowl ring surface 43 urging the fingers inwardly so that the serrated surfaces 41 on the fingers are compressed into locking engagement with the outer surface of the top joint of the blast joint, thereby restraining the rings 32 against upward movement on the tubing joint. During installation, the ring retainer is installed first on the blast joint by sliding the ring retainer upwardly from the lower end of the top joint to the position shown in FIG. 2A at which the ring retainer is locked in position.

Figure 2B:
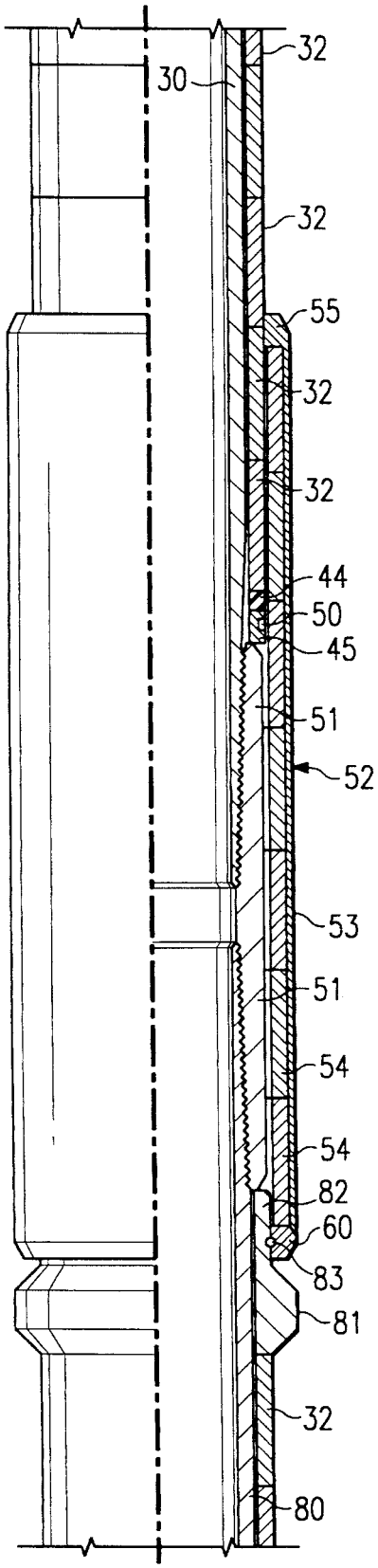

After the ring retainer 33 is locked on the top tubular joint 30 of the blast joint, the requisite number of the carbide rings 32 are slid over the lower pin end of the top joint 30 as represented in FIGS. 2A and 2B, until the top joint is totally encased by the rings 32 to a position adjacent the upper end of the lower pin end of the top joint. The number of the rings 32 on the top joint 30 depend upon the axial length of each ring and the length of the tubing joint. The carbide rings 32 while very resistant to the erosive action of fluids and particles entrained in the fluids in the well bore are brittle and may chip, crack, or break during installation and operation of the blast joint. The carbide rings particularly tend to chip in compression. Accordingly, the rings are spaced from the tubing to provide clearance between the outer surface of the tubing joints and the internal surface of the carbide rings to permit some pivotal movement of the tubing without excessive stress on the rings. In a typical installation using a standard 30 foot tubing joint, a clearance of 0.061 inch between the tubing and the inside diameter of the carbide rings has been found to allow pivotal movement of the tubing within the rings without damaging the rings.

Figure 6:
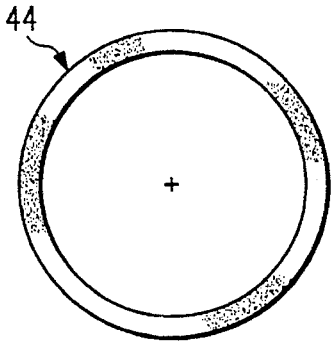
FIG. 6 is a top view of one of the elastomer impact rings spaced along the blast joint.
Figure 7:
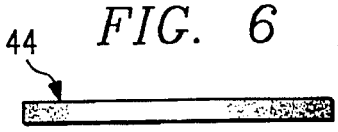
FIG. 7 is a side view of the impact ring of FIG. 6.
Figure 8:
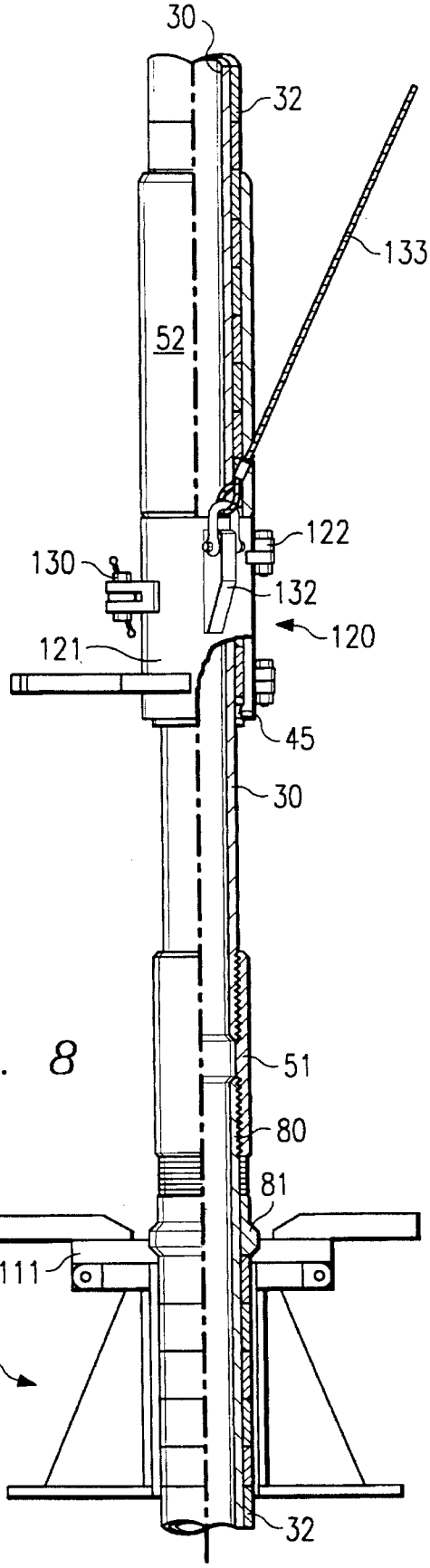
FIG. 8 is a longitudinal fragmentary view in section and elevation of top and intermediate joints of the blast joint of the invention and an assembly stand and ring elevator employed during the installation of the blast joint.

Referring to FIG. 2B, following the installation of the carbide rings 32 on the top tubing joint 30 down to the lower pin end of the joint, in accordance with the invention, an elastomer spacer ring 44 is installed on the tubing joint at the lower end of the lowermost carbide ring 32 followed by a short support ring 45. Details of the shape of the elastomer spacer ring are shown in FIGS. 6 and 7. The short support ring 45 is provided with an external annular ring elevator groove 50 the function of which is illustrated in FIG. 8 and described hereinafter. An internally threaded coupling 51 is screwed on the lower pin end of the top tubing joint 30 in abutting engagement with the short support ring 45 providing a lower stop shoulder for the stack of carbide rings 32 and the elastomer spacer ring 44. The coupling 51 is threaded on the joint 30 until proper torque makeup is achieved at which point the spacer ring 44 extrudes radially outwardly. The stack of rings 32 are held in end-to-end contact without compression between the rings while the elastomer ring allows end-to-end movement of the rings to minimize ring damage during assembly and installation.

Figure 3:
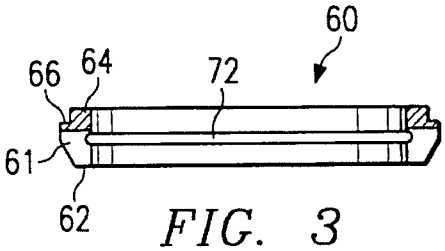
FIG. 3 is a sectional view of the lower cover ring of the coupling shields.
Figure 4:
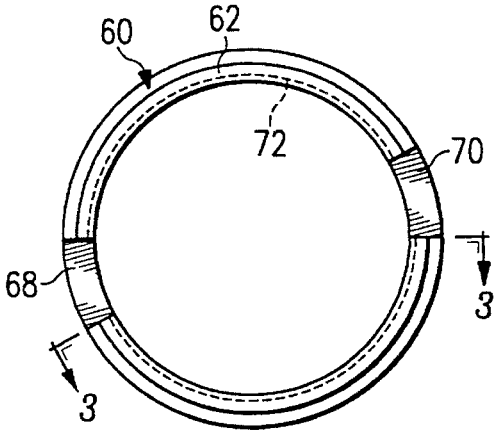
FIG. 4 is a bottom view of the cover ring shown in FIG. 3.

Referring to FIG. 2B, a moveable short protective sleeve assembly 52, shown in closed position in FIG. 2B, protects the tubing coupling 51 and related structure. The sleeve assembly 52 includes a sleeve 53 encasing carbide rings 54 which have an internal diameter slightly greater than the outer diameter of the carbide rings 32. The rings 54 are in end-to-end contact within the sleeve 53 between an upper cover ring 55 and a lower cover ring 60 welded into the ends of the sleeve 53. The lower cover ring 60 is shown in detail in FIGS. 3 and 4. The internal diameter of the cover ring 60 is slightly greater than the external diameter of the short support ring 45 so that it fits snugly about the support ring. The cover ring 60 includes a short tubular body 61 the outer diameter of which tapers inwardly at the lower end thereof to a flat planar circumferential surface 62 defining the lower or bottom end of the cover ring. The opposite end of the body 61 includes an upstanding cylindrical extension 64 having an outer diameter slightly less than the inner diameter of the sleeve 52. A circumferential shoulder 66 provides an abutment surface for the sleeve 52 the lower end of which telescopes over the extension 64 of the lower cover ring and is welded thereto. Similarly, the opposite end of the sleeve 52 is welded to the upper cover ring 55 forming a moveable assembly of the stacked carbide rings 54 slideable along the blast joint to provide a protective cover for the coupling 51. As illustrated in FIG. 4, the lower end of the cover ring body 61 is slotted at 68 and 70 permitting access to an internal annular retaining wire groove 72 in the lower cover ring which functions to hold the sleeve assembly at a lower position as illustrated and discussed hereinafter.

Figure 2C:
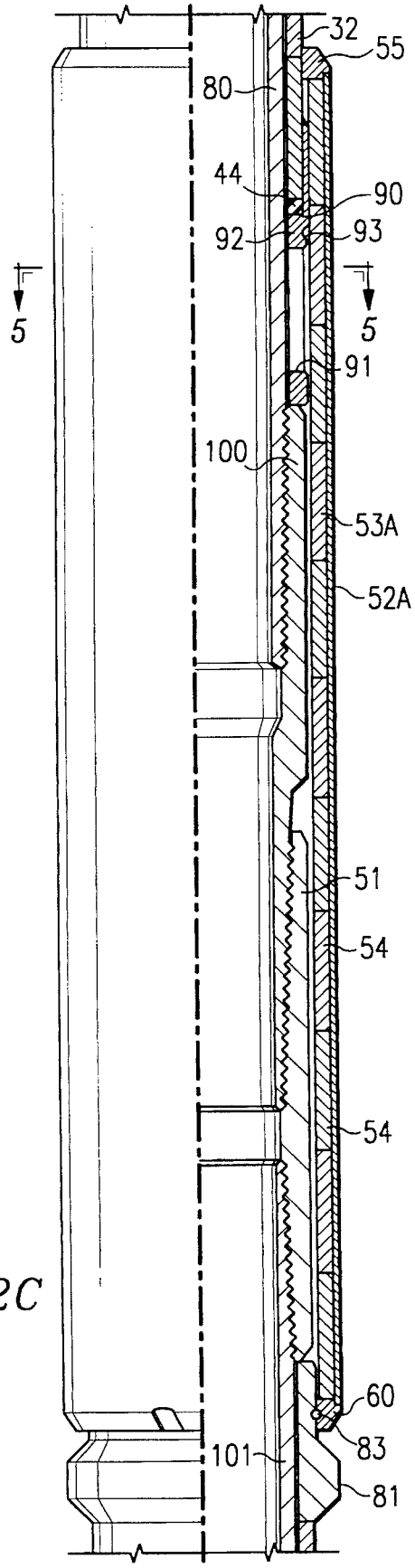
Figure 5:
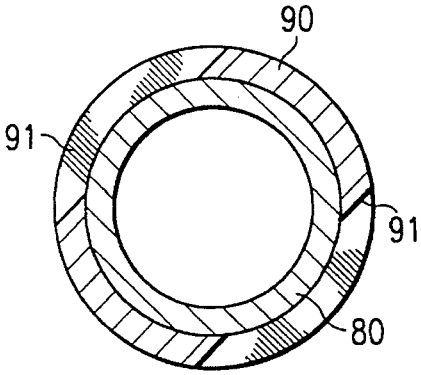
FIG. 5 is a sectional view taken along the line 5—5 of FIG. 2C showing only the production tubing joint in section and the support sleeve for the long coupling shield partially in section and partially in elevation.

Referring to FIGS. 2B and 2C, an intermediate tubing joint 80 is connected at the upper pin end into the lower internal threaded end of the coupling 51. A carbide guide ring 81 followed by a plurality of carbide rings 32 are slid on the intermediate tubing joint 80 with the guide ring 81 engaging the lower end of the coupling 51. An upper reduced portion 82 of the guide ring has an external annular retaining wire groove cooperating with the internal groove 72 of the lower cover ring 60 to lock the lower cover ring with the retainer ring to hold the short cover assembly 52 at the lower closed position of FIG. 2B. The carbide rings 32 extend to a location spaced shortly above the lower pin end of the intermediate tubing joint 80. An elastomer spacer ring 44 is installed on the tubing joint 80 at the lower end of the lowermost carbide ring 32. A support sleeve 90 is installed on the intermediate tubing string 80 below and engaging the elastomer spacer ring 44. The support sleeve 90 is a substantially cylindrical open ended member provided with a pair of oppositely located slots or apertures 91, FIG. 5, permitting access through the sleeve to the tubing joint 80 within the sleeve. The support sleeve 90 has an upper collar portion 92 provided with an external annular retainer wire recess 93. The retainer wire recess is provided to cooperate with a corresponding retainer wire groove in a lower cover ring of a sleeve assembly to hold the sleeve assembly in a desired position, such as open when couplings are being made between connecting tubing joints of the blast joint. A tubing joint cross-over sub 100 is threaded on the pin end of the intermediate tubing joint 80 in abutting engagement with the lower end of the support sleeve 90 providing a lower stop shoulder for the stack of carbide rings 32 above the support sleeve and the elastomer spacer ring 44. The sub 100 holds the rings 32 in end-to-end non-compression contact when made-up to the proper torque on the pin end of the joint 80 against the spacer ring 44. Another tubing coupling 51 is threaded on the lower pin end of the cross-over sub 100 shown in FIG. 2C.

Referring to FIG. 2C, a long sleeve assembly 52A is installed over the intermediate tubing joint 80 along the cross-over sub 100 and the coupling 51 threaded on the cross-over sub to protect the cross-over sub and coupling of the blast joint from fluids and particles entering the well bore. The long sleeve assembly 52A is identical in construction to the sleeve assembly 52 including a longer sleeve 53A connected between an upper cover ring 55 and a lower cover ring 60 encasing a stack of carbide rings 54 sufficient in number to protect the cross-over sub 100, coupling 51, and the support sleeve 90.

Figure 2D:
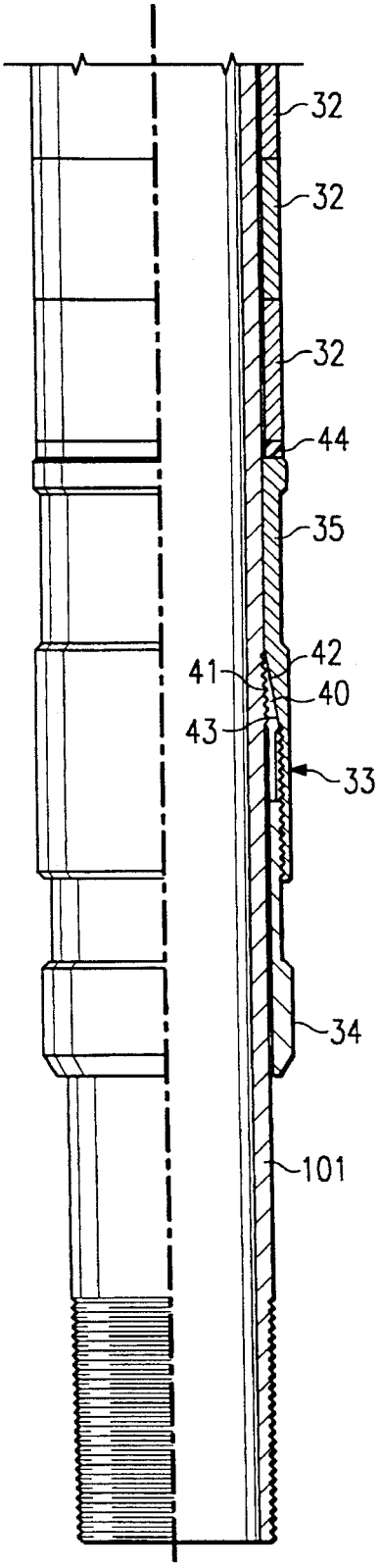

A bottom or lower tubing joint 101 is threaded along an upper pin end into the coupling 51 as shown in FIG. 2C. The moveable long sleeve assembly 52A may be installed over the cross-over sub 100 and the support sleeve 90 sliding the long sleeve assembly upwardly over the carbide rings 32 until the lower cover ring 60 of the sleeve assembly is aligned with the upper collar 92 of the support sleeve 90. A retainer wire is inserted into the groove between the support sleeve upper collar and the lower cover ring 60 locking the long sleeve assembly 52A in an upper position while the coupling 51 and the bottom tubing joint 101 are made up on the lower end of the cross-over sub 100. A guide ring 81 followed by a stack of carbide rings 32 are then slid upwardly on the bottom tubing joint 101 until the guide ring 81 engages the lower end of the coupling 51 as in FIG. 2C. An elastomer spacer ring 44 is then installed at the lower end of the lowermost carbide ring 32 as shown in FIG. 2D. A ring retainer assembly 33 is installed on the lower tubing joint 101 against the spacer ring 44 supporting the stack of carbide rings extending from the lower ring retainer assembly as in FIG. 2D to the guide ring 81 along the upper end portion of the lower tubing joint as in FIG. 2C. The ring retainer assembly 33 along the lower end portion of the tubing joint 101 is identical in construction and installation to the ring retainer assembly 33 illustrated and described with respect to FIG. 2A. The ring retainer assembly 33 is installed against the spacer ring 44 to hold the rings 32 in end-to-end non-compression contact along the tubing joint 101 while the spacer ring yields to allow the rings 32 to move enough to protect the rings.

The preferred embodiment of the blast joint of the invention illustrated in FIGS. 2A–2D includes one of the elastomer spacer rings 44 at the lower end of each series of carbide rings 32. It is to be understood, however, that two or more such spacer rings may be used as necessary to permit the proper torque to maintain the rings in end-to-end contact while allowing the rings to yield responsive to bending and impact forces on the blast joint, as well as, to permit the necessary spacing out along the blast joint of its various components to attain the proper assembly. Additionally, while each of the spacer rings 44 is shown located at the lower end of a series of carbide rings, a spacer ring may also be placed at the upper end of the carbide rings series to permit movement of the rings during assembly, installation, and operation of the blast joint. As previously discussed, the elastomer spacer rings hold the carbide rings to maintain them in end-to-end contact to fully protect the tubing string against erosion from the incoming fluids and particles while permitting sufficient movement of the rings to minimize chipping or any other damage to the rings resulting from bending stresses when lifting the blast joint from a horizontal to a vertical position for installation while providing sufficient shock absorber function during installation to minimize damage, preventing debris from collecting between the rings, allowing sufficient torque for spacing out during assembly, and deforming sufficiently to allow proper makeup. In addition to the protection provided by the elastomer spacer rings, the clearance of the carbide rings around the tubing joints allows tubing flexing without excessive stress on the carbide rings.

Prior art details of some installation procedures which may be used with the blast joint of the invention may be found in the previously referred to U.S. Pat. Nos.: 4,685,518; 4,726,423; and 4,889,185. Other installation steps are described hereinafter. The blast joint components may be preassembled on a pipe rack, taken to the well site, and installed in the well bore.

The blast joint 10 of the present invention comprises the series of tubing joints encased or shielded by erosion resistant rings mounted on the joints in the manner described above. More specifically, the blast joint 10 as described includes the top tubing joint 30, one or more of the intermediate tubing joints 80, and the bottom tubing joint 101. Installation of the blast joint 10 is accomplished by fitting the top intermediate and bottom tubing joints together in the tubing string 11 in the well bore 14. Running tubing in a well bore is well known in the prior art. Typically, the lower portion of the tubing string is suspended in the well bore from the oil rig platform floor. Pipe slips are usually used to grip the upper end of the tubing string and suspend it from the rotary table while the next tubing joint is threaded to the upper end of the tubing string. The tubing string is then lifted slightly and the pipe slips are removed permitting the tubing string to be lowered in the well bore. The process is repeated until the tubing string is completed.

When incorporating the blast joint 10 in the tubing string 11, the brittle nature of the carbide rings 32 which tends to cause them to chip, crack, or break during the installation process prevents the use of standard pipe slips to suspend the tubing string and blast joint in the well bore while connecting the joints together. Accordingly, special installation equipment illustrated in FIGS. 8–10 and in U.S. Pat. No. 4,726,423 are employed. The bottom, intermediate, and top tubing joints are partially assembled on the pipe rack as previously described. Referring to FIG. 8, a base assembly 110 is positioned on the rotary table, not shown, coaxially aligned with the tubing string 11. The specific structural details and the operation of the base assembly are described in U.S. Pat. No. 4,726,423 which shows an identical base assembly 90 illustrated in such patent in FIGS. 7 and 8. The bottom tubing joint 101 of the blast joint 10 is raised from the platform floor and threaded to the tubing string joints suspended in the well bore from the rotary table. The joint 101 is lowered in the well bore 14 through the base assembly 110. The diameter of the axial passage through the base assembly is greater than the greatest diameter of the blast joint 10 so that the blast joint passes through the base assembly without contacting the carbide rings 32. The blast joint 101 and the tubing string 11 connected with and suspended from the blast joint 101 is then suspended from the base assembly 110 by rotating the tool support plates 111 to the closed positions at which the guide ring 81, FIG. 2C, engages and rest on the support plates as seen in FIG. 8. The intermediate blast joint 80 is then raised from the rig platform floor and the pin end of the cross-over sub 100 is threaded into the coupling 51 projecting above the base assembly. As discussed in U.S. Pat. No. 4,726,423, at this juncture in the installation procedure the long sleeve assembly 52A is held at an upper position above the support sleeve 90 by a wire retainer between the lower cover ring 60 and the upper support sleeve collar 92. This provides adequate room for the platform personnel to securely thread the intermediate joint 80 to the lower joint 101. After completion of this connection, the retaining wire holding the long protective sleeve assembly 52A is removed and the sleeve assembly is lowered to the guide ring 81 and a retaining wire is inserted between the lower cover ring 60 and the guide ring 81 locking the sleeve 52A at the lower position to provide a protective cover over the coupling 51 and the cross-over sub 100. This process maybe repeated for each of the intermediate tubing joints 101 included in the blast joint.

Figure 9:
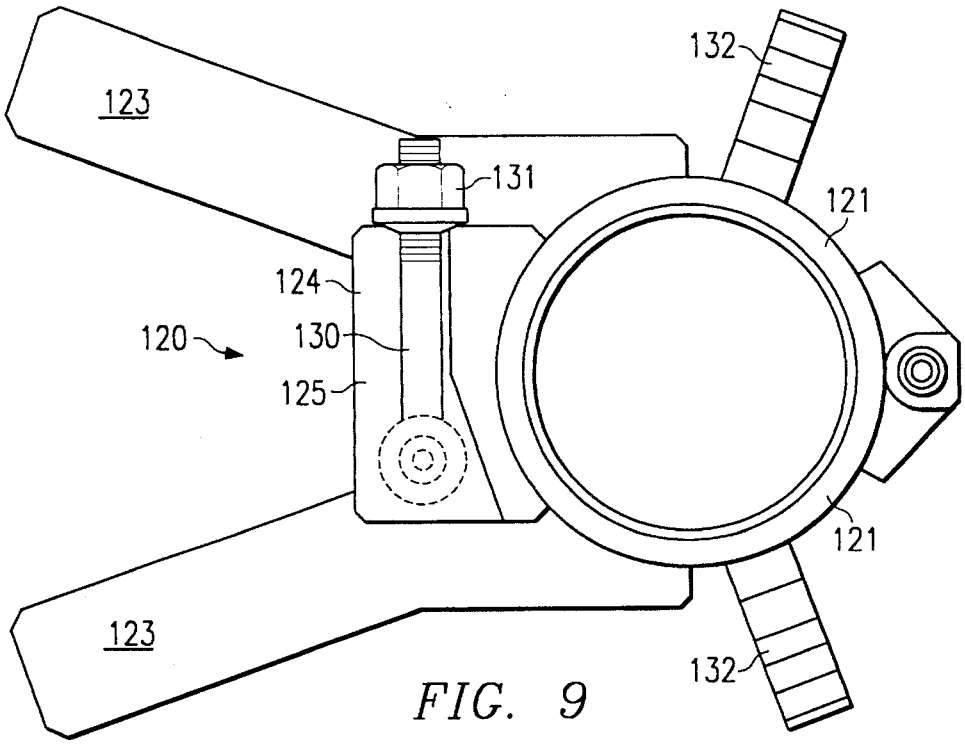
FIG. 9 is an enlarged top view of the ring elevator illustrated in FIG. 8.
Figure 10:
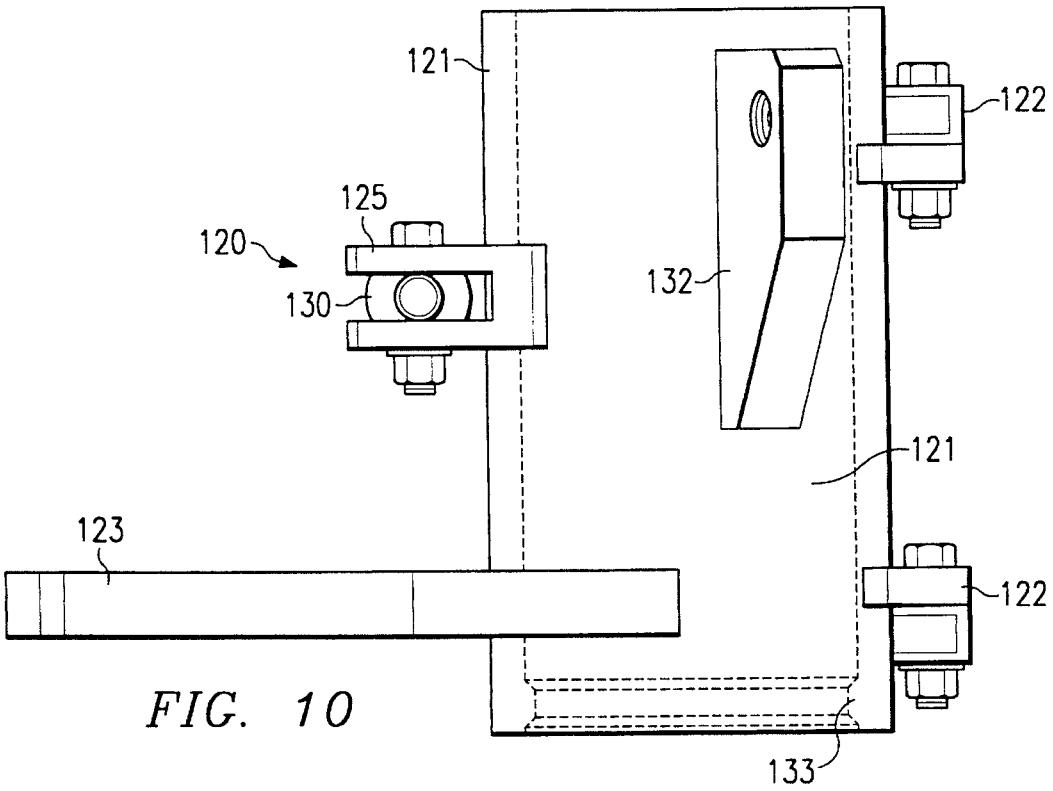
FIG. 10 is a side view in elevation of the ring elevator of FIG. 9.

The structural assembly for installation of the top joint 30 of the blast joint requires the continued use of the base assembly 110 together with a ring elevator 120 illustrated in FIGS. 8, and 9 and 10. Referring to FIGS. 9 and 10, the ring elevator includes a split sleeve formed by sleeve halves 121 hinged together by bolt assemblies 122. Each of the sleeve halves has an operating handle 123 for opening and closing the sleeve halves, so that the split sleeve may be placed and clamped around a tubing joint. One of the sleeve halves has a slotted locking bracket 124 while the other sleeve half has a slotted locking bracket 125. A bolt 130 is hinged at one end to the locking bracket 125 and movable into the slotted locking bracket 124 where it is held by a nut 131 to lock the split sleeve in the closed position illustrated in FIGS. 8–10. Each of the sleeve halves has a cable connection bracket 132 for connecting elevator cables 133, FIG. 8, to raise and lower the ring elevator. As seen in FIG. 10 the sleeve halves each have an internal boss 133 which is engagable with the external recess 50 around the short support ring 45 when the sleeve halves 121 are closed around the top tubing joint 30 to lift the carbide rings 32 on the top tubing joint upwardly during the makeup of the lower end of the top tubing joint with the upper end of the first intermediate joint. Previous to bringing the top joint to the rig floor on the pipe rack, the top joint is partially assembled by installing the ring retainer 33 and the carbide rings 32 on the top joint 30 down through the elastomer spacer ring 44 and the short support ring 50. A bottom support, not shown, is threaded on the joint to hold the rings 32 and related parts on the joint preliminary to installation. The top joint is brought to the rig floor and picked up with the rig elevators. The short sleeve assembly 52 is placed on the top joint and held two or three feet above the bottom of the joint. The ring elevator is then installed on the top joint by clamping the elevator half sleeves 121 around the joint with the internal bosses 133 engaging the external recess 50 on the short support ring 45. The short sleeve assembly 52 is then lowered to rest on the top of the ring elevator 120 as illustrated in FIG. 8. Lines 133 are attached to the ring elevator and the stack of carbide rings 32 along with the top retainer 33 are lifted up one or two feet. The bottom support is removed from the tubing and the connection is made up between the lower end of the top tubing joint 30 and the upper end of the intermediate tubing joint 80 with the coupling 51. The ring elevator is then lowered with the lines 133 resting the short support ring on the upper end of the coupling. The short sleeve assembly 52 is moved upwardly off the ring elevator and the ring elevator is removed. The short sleeve assembly is then lowered down to the guide ring 81 where the retainer wire 83 is installed through the lower cover ring into the retainer wire groove in the guide ring 81 locking the short cover assembly 52 at the lower protective position around the coupling 51 as illustrated in FIG. 2B. The base assembly 110 is then removed and the production string is lowered until the top retainer 33 is at a suitable working height. The top retainer 33 is then tightened on the tubing joint 30 engaged with the uppermost carbide ring 32 on the joint. The blast joint 10 is then lowered with the production string 11 into the borehole.

The embodiment of the blast joint of the invention illustrated in FIGS. 1 and 2A–2D, shows a single intermediate tubing joint 80 connected between the top and bottom tubing joints. It is to be understood that this is illustrative only, and that if the producing formation requires a longer blast joint, additional intermediate tubing joints may be employed, utilizing the same components and assembly and installation procedures previously described. Whatever length of blast joint is necessary to traverse a producing formation may be constructed of a sufficient number of intermediate tubing joints connected between the top and bottom tubing joints, all being encased within carbide rings 32 and the short and long protective sleeve covers for the couplings between the tubing joints. If desired, the blast joint may comprise a single tubing joint utilizing upper and lower ring retainers 33 installed as shown in FIGS. 2A and 2D holding the required number of carbide rings 32 including one or more of the elastomer spacer rings 44.

While preferred embodiments of the blast joint of the invention have been described and illustrated, other forms of blast joints may be constructed within the scope of the invention.

What is claimed is:

1. A blast joint for protecting a production tubing through a producing zone comprising:

(a) a tubing joint connectible at an upper end into the production robing;

(b) an upper ring retainer along an upper end portion of the robing joint;

(c) a lower ring retainer along the tubing joint spaced below the upper ring retainer;

(d) a plurality of erosion resistant rings around the tubing joint in non-compressive end-to-end contact between the upper and lower ring retainers; and (e) an compressible and extrudible elastomer spacer ring on the tubing joint between the ring retainers engaged only in a non-overlapping relationship with the lower end of the lowest of the erosion resistant rings to permit proper torque on the lower ring retainer to maintain the rings in non-compressive end-to-end contact while allowing the rings to move along the tubing joint responsive to bending and impact forces on the blast joint and to permit the necessary spacing out along the blast joint of its components to attain proper assembly to minimize damage to the erosion resistant rings during assembly, installation, and operation of the blast joint.

2. The blast joint of claim 1 wherein the erosion resistant rings are radially spaced around the tubing joint to permit the tubing joint to flex laterally with minimum stress to the erosion resistant rings.

3. The blast joint of claim 1 where the ring retainers comprise a bowl ring and a slip ring threadedly connected, the slip ring having a plurality of circumferentially spaced serrated fingers for griping engagement with the tubing joint.

4. The blast joint of claim 2 where the ring retainers comprise a bowl ring and a slip ring threadedly connected, the slip ring having a plurality of circumferentially spaced serrated fingers for griping engagement with the tubing joint.

5. A blast joint for protecting a production tubing through a producing zone comprising:

(a) an upper tubing joint connectible along an upper threaded end portion with the production tubing;

(b) a ring retainer on an upper end portion of the upper tubing joint spaced from the threaded end portion of the joint;

(c) a plurality of erosion resistant rings on the upper tubing joint in end-to-end array, the uppermost ring engaging the ring retainer;

(d) an elastomer spacer ring on the upper tubing joint below and engaged with the lowermost of the erosion resistant rings for holding the erosion resistant rings in end-to-end contact while being yieldable axially by outward displacement to permit movement of the erosion resistant rings along the tubing joint to minimize damage to the erosion resistant rings during assembly, installation, and operation of the blast joint;

(e) a short support ring on the upper tubing joint engaged with the elastomer spacer ring and spaced from a lower threaded end portion of the upper tubing joint;

(f) tubing coupling means threaded on the lower threaded end portion of the upper tubing joint engaging the short support ring and holding the elastomer spacer ring and the erosion resistant rings on the upper tubing joint in compression;

(g) an intermediate tubing joint threaded along an upper end portion into the tubing coupling means connected on the lower end of the upper tubing joint;

(h) an erosion resistant guide ring on an upper end portion of the intermediate tubing joint engaged with the tubing coupling means between the upper and intermediate tubing joints;

(i) an erosion resistant protective sleeve axially slidably mounted on the upper and intermediate tubing joints moveable from a first position around the guide ring and tubing coupling means and lowermost erosion resistant ring on the upper tubing joint to a second position above the coupling means to permit makeup of the coupling means on the upper and intermediate tubing joints;

(j) a plurality of erosion resistant rings on the intermediate tubing joint from the guide ring along the upper end of the intermediate tubing joint to a lower end portion of the intermediate tubing joint;

(k) an elastomer spacer ring on the lower end portion of the intermediate tubing joint engaged with the lowermost erosion resistant ring on the intermediate tubing joint to hold the erosion resistant rings on the intermediate tubing joint in end-to-end contact while being yieldable axially by outward displacement to permit movement of the erosion resistant rings along the intermediate tubing joint to minimize damage to the erosion resistant rings during assembly, installation, and operation of the blast joint;

(l) a long support ring on the intermediate tubing joint above a lower threaded end portion of the intermediate tubing joint engaged with the elastomer spacer ring below the lowermost erosion resistant ring on the intermediate tubing joint, the long support ring having oppositely positioned side slots for access through the long support ring to the intermediate tubing joint;

(m) tubing coupling means threaded on the lower end portion of intermediate tubing joint, the upper edge of the tubing coupling means engaging the lower end edge of the long support ring on the intermediate tubing joint;

(n) a lower tubing joint threaded along an upper end portion into the tubing coupling means connected with the lower end of the intermediate tubing joint;

(o) an erosion resistant guide ring on an upper end portion of the lower tubing joint engaged with a lower end of the tubing coupling means connecting the lower tubing joint with intermediate tubing joint;

(p) an erosion resistant protective sleeve axially slidable mounted on the intermediate and lower tubing joints moveable from a first position around the guide ring on the lower tubing joint, the coupling means between the intermediate and lower tubing joint and the lowermost erosion resistant ring on the lower end of the intermediate tubing joint to a second position above the coupling means between the intermediate and lower tubing joint to permit makeup of the coupling means between the intermediate and lower tubing joint;

(q) a plurality of erosion resistant rings on the lower tubing joint in end-to-end array, the uppermost ring engaging the guide ring along the upper end portion of the lower tubing joint and the lowermost of the erosion resistant rings on the lower tubing joint being spaced above a lower end portion of the lower tubing joint;

(r) an elastomer spacer ring on the lower tubing joint engaged with the lowermost erosion resistant ring on the lower tubing joint for holding the plurality of erosion resistant rings on the lower tubing joint in end-to-end contact while being yieldable axially by outward displacement to permit movement of the erosion resistant rings along the lower tubing joint to minimize damage to the erosion resistant rings during assembly, installation, and operation of the blast joint; and (s) a lower ring retainer along a lower end portion of the lower tubing joint engaged with the elastomer spacer ring at the lower end of the lowermost erosion resistant ring on the lower tubing joint holding the elastomer ring and the erosion resistant rings along the lower tubing joint in compression.

6. A blast joint in accordance with claim 5 where the erosion resistant rings each have an inside diameter larger than the outside diameter of the tubing joints within the erosion resistant rings to permit flexing of the tubing joints with minimum stress on the erosion resistant rings.

7. A blast joint in according to claim 5 including a plurality of elastomer spacer rings at the location of each of the spacer rings along the blast joint.

8. A blast joint according to claim 6 including a plurality of elastomer spacer rings at the location of each of the spacer rings along the blast joint.

9. A blast joint according to claim 5 including a plurality of the intermediate tubing joints, the erosion resistant rings on the intermediate tubing joints, the elastomer spacer rings engaging the erosion resistant rings, and the moveable erosion resistant sleeves protecting the coupling means interconnecting the intermediate tubing joints.

10. A blast joint in according to claim 6 including a plurality of the intermediate tubing joints, the erosion resistant rings on the tubing joint, the elastomer spacer rings engaging the erosion resistant rings, and the erosion resistant sleeves protecting the coupling means interconnecting the intermediate tubing joints.

11. A blast joint according to claim 5 where each protecting sleeve includes a series of erosion resistant rings within an outer sleeve between end cover rings.

12. A blast joint according to claim 6 where each protective sleeve includes a series of erosion resistant rings within an outer sleeve between end covers.

13. A blast joint for protecting production tubing passing through a producing zone comprising:

(a) at least two tubular members having threaded opposed ends;

(b) a plurality of erosion resistant rings in non-compressive end-to-end contact encasing each of said tubular members;

(c) support means for supporting the erosion resistant rings about the tubular members;

(d) compressible and extrudible elastomer spacer ring means engaged only in a non-overlapping relationship with the lower end of the lowest one of each plurality of the erosion resistant rings between the support means to permit proper torque on the lowest of the support means at the lower end of each plurality of erosion resistant rings to maintain the rings in non-compressive end-to-end contact while allowing the rings to move longitudinally along the tubular members responsive to bending and impact forces on the blast joint and to permit the necessary spacing out along each of the tubular members of the blast joint components to attain proper assembly;

(e) connector means for connecting the tubular members to form the blast joint; and (f) at least one erosion resistant ring assembly supported on the tubular members in telescoping relation about the erosion resistant rings, the ring assembly being moveable between a first and a second position, wherein the ring assembly encloses the connector means upon shifting the ring assembly to the second position.

14. A blast joint in accordance with claim 13 wherein the erosion resistant rings have an inside diameter greater than the outside diameter of the tubular members enclosed by the erosion resistant rings to permit the tubular members to flex laterally with minimum stress on the erosion resistant rings around the tubular members.

* * * * *

UNITED STATES PATENT AND TRADEMARK OFFICE

CERTIFICATE OF CORRECTION

PATENT NO. : 5,549,333

DATED : Aug. 27, 1996

INVENTOR(S) : Uherek, Sr. et al.

It is certified that error appears in the above-indentified patent and that said Letters Patent is hereby corrected as shown below:

| | |
|---|---|
| **Column 9, line 18** | Replace "robing"<br>With --tubing-- |
| **Column 9, line 20** | Replace "robing"<br>With --tubing-- |

Signed and Sealed this

Twenty-seventh Day of May, 1997

*Attest:*

*Attesting Officer*

BRUCE LEHMAN

*Commissioner of Patents and Trademarks*